US007121525B2

(12) United States Patent
Gelez

(10) Patent No.: US 7,121,525 B2
(45) Date of Patent: Oct. 17, 2006

(54) METHOD OF DETERMINING A CLEARANCE

(75) Inventor: Nicolas Gelez, Le Chesnay (FR)

(73) Assignee: Johnson Controls Technology Company, Holland, MI (US)

( * ) Notice: Subject to any disclaimer, the term of this patent is extended or adjusted under 35 U.S.C. 154(b) by 79 days.

(21) Appl. No.: 10/522,293

(22) PCT Filed: Jul. 10, 2003

(86) PCT No.: PCT/FR03/02170

§ 371 (c)(1),
(2), (4) Date: Jan. 25, 2005

(87) PCT Pub. No.: WO2004/016912

PCT Pub. Date: Feb. 26, 2004

(65) Prior Publication Data

US 2005/0269536 A1 Dec. 8, 2005

(30) Foreign Application Priority Data

Jul. 25, 2002 (FR) ..... 02 09434

(51) Int. Cl.
*F01L 9/04* (2006.01)

(52) U.S. Cl. ..... 251/129.19; 251/129.1; 251/129.15; 137/1; 137/551; 137/553; 123/90.11

(58) Field of Classification Search ..... 251/129.19
See application file for complete search history.

(56) References Cited

U.S. PATENT DOCUMENTS

| | | | | |
|---|---|---|---|---|
| 5,711,259 | A | 1/1998 | Pischinger et al. | |
| 5,832,955 | A | 11/1998 | Schrey | |
| 6,167,852 | B1 * | 1/2001 | Kamimaru et al. | 123/90.11 |
| 6,247,432 | B1 * | 6/2001 | Pischinger et al. | 123/90.11 |
| 7,014,167 | B1 * | 3/2006 | Fuwa | 251/129.04 |

* cited by examiner

*Primary Examiner*—J. Casimer Jacyna
(74) *Attorney, Agent, or Firm*—Osha Liang LLP

(57) ABSTRACT

A method of determining timing clearance between a valve stem and a moving member using an electromagnetic actuator comprising electromagnets, an electromagnet for moving the moving member from a closed position towards an open position and an electromagnet for moving the moving member from an open position towards a closed position, each electromagnet being controlled on the basis of a reference electrical characteristic, the method comprising: controlling an electromagnet to obtain a displacement speed for a moving member as the moving member moves from one of a closed position or an open position towards the other one of an open position or a closed position; obtaining values of a reference electrical characteristic for intermediate positions of the moving member; and detecting an intermediate position at which the reference electrical characteristic is subject to a sudden change.

27 Claims, 1 Drawing Sheet

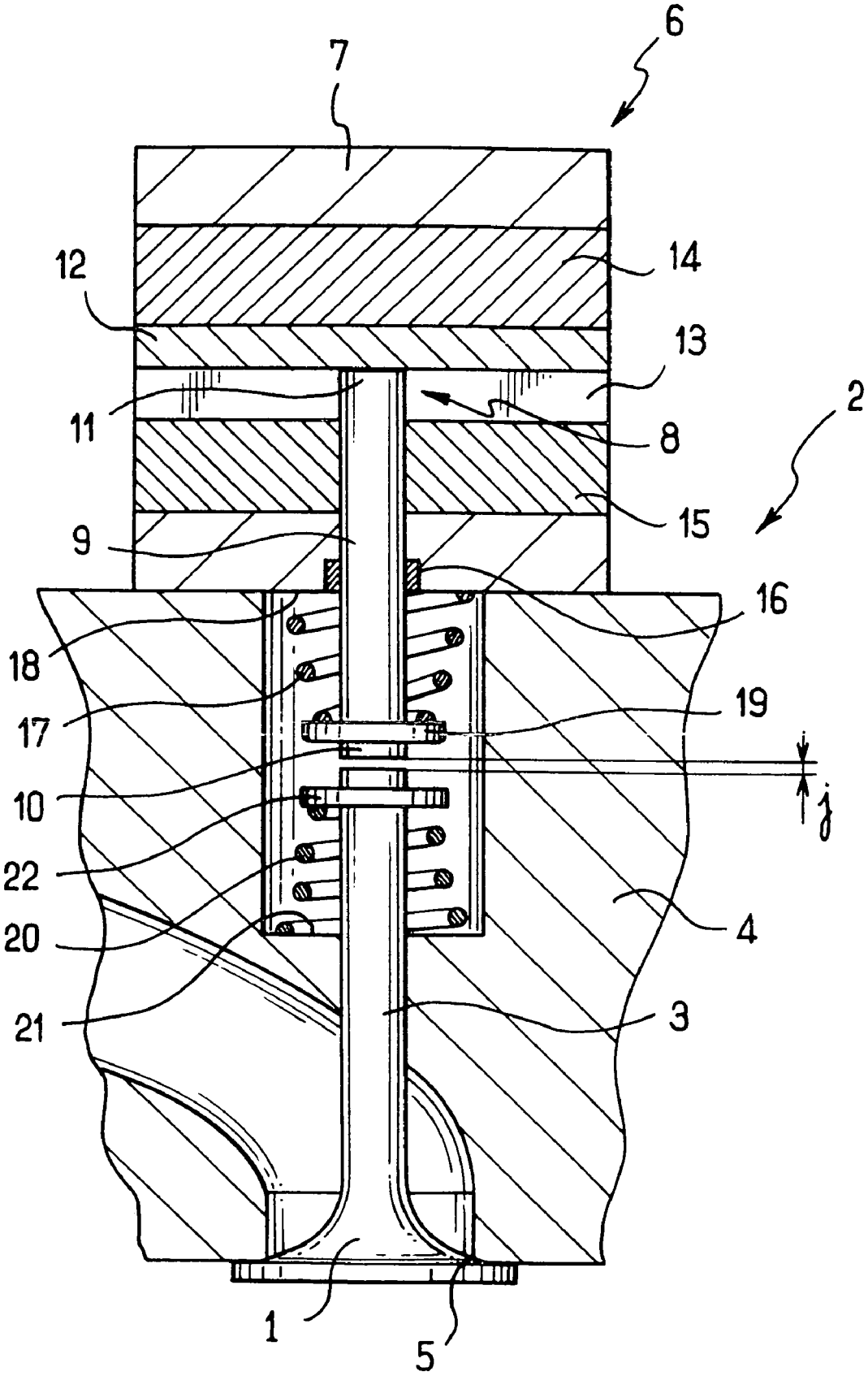
6
7
12
14
13
11
8
2
15
9
16
18
19
17
10
j
22
4
20
21
3
1
5

METHOD OF DETERMINING A CLEARANCE

CROSS REFERENCE TO RELATED APPLICATIONS

This application is a National Stage of application PCT/FR03/02170, filed Jul. 10, 2003, and claims priority to French patent application 02 09434 filed Jul. 25, 2002, the disclosures of which are incorporated herein by reference in their entirety.

FIELD

The present invention relates to a method of determining timing clearance between two moving parts.

BACKGROUND

Conventional electromagnetic valve actuators comprise both resilient displacement means and electromagnetic actuator means for actuating the moving member between two extreme positions which correspond respectively to the open position of the valve and to the closed position of the valve. The resilient displacement means generally comprise a spring associated with the moving member to return it elastically into its extreme open position, and a spring associated with the valve stem in order to return it elastically into its closed position so as to urge the moving member elastically into its extreme closed position. The electromagnetic actuator means generally comprise an electromagnetic displacement means for bringing and/or holding the moving member in its extreme open position, and an electromagnet for bringing and/or holding the moving member in its extreme closed position.

In order to be certain that the valve is properly pressed against its seat when the moving member is in its extreme closed position and therefore the moving member and the valve are not connected to each other, timing clearance is provided between the moving member and the valve stem when the moving member is in its extreme closed position and the valve is properly pressed against its seat by the spring which is associated therewith.

Under such circumstances, if the moving member is brought quickly from the extreme closed position to the extreme open position, the moving member will strike the valve stem. This impact, which in any event is noisy, leads to mechanical stresses and wear of the moving member and of the valve stem that can, in extreme cases, lead to damage thereof. It is therefore important to know precisely the amount of timing clearance that exists so that the electromagnetic means can be controlled firstly to bring the moving member gently into contact with the valve stem, and then to accelerate the moving member once it is pressing against the valve stem.

Unfortunately, timing clearance varies while the engine is in operation, in particular as a function of temperature, and also over the lifetime of the engine, in particular as a function of the wear of the valve and of the various components of the valve actuator. In addition, timing clearance can vary from one valve actuator to another as a function of their manufacturing tolerances.

In order to determine the timing clearance, a conventional method comprises controlling the valve actuator means to move the moving member from the extreme closed position to the extreme open position and to detect variation in an electrical characteristic of the electromagnetic actuator means. This variation in the electrical characteristic is caused by the increase in the opposition to movement of the moving member once it encounters the valve stem. The timing clearance is then determined by measuring the time that elapses between the beginning of the moving member being set into motion and the start of variation in the electrical characteristic. Nevertheless, determining timing clearance in that way turns out to be relatively inaccurate. Thus, there is a need for a method of determining timing clearance simply and accurately.

SUMMARY

A first embodiment of the invention is a method of determining timing clearance between a valve stem and a moving member using an electromagnetic actuator comprising electromagnetic displacement means which comprise electromagnets for moving the moving member between an extreme closed position and an extreme open position, the electromagnets of the electromagnetic displacement means being controlled by servo-control means on the basis of a reference electrical characteristic. The method comprising: controlling the electromagnetic displacement means to obtain a substantially constant displacement speed for the moving member as the moving member moves between the extreme closed position and the extreme open position; obtaining values of the reference electrical characteristic for intermediate positions of the moving member; and detecting an intermediate position at which the reference electrical characteristic is subject to a sudden change. The method can further comprise deducing the timing clearance from the intermediate position at which the reference electrical characteristic is subject to a sudden change and the extreme closed position.

One advantage of the method is that it is a simple, yet accurate method for determining timing clearance. A further advantage of the method is that it can be used to determine the timing clearance in a machine while the machine is in operation in its normal state or in an idle state since the implementation of the method does not interfere with normal operation of the machine and does not generate additional noise.

A second embodiment of the invention is a method of determining timing clearance between a valve stem and a moving member using an electromagnetic actuator comprising electromagnets, an electromagnet for moving the moving member from a closed position towards an open position and an electromagnet for moving the moving member from an open position towards a closed position, each electromagnet being controlled on the basis of a reference electrical characteristic. The method comprises: controlling an electromagnet to obtain a displacement speed for a moving member as the moving member moves from one of a closed position or an open position towards the other one of an open position or a closed position; obtaining values of a reference electrical characteristic for intermediate positions of the moving member; and detecting an intermediate position at which the reference electrical characteristic is subject to a sudden change. The method can further comprise deducing the timing clearance from the intermediate position at which the reference electrical characteristic is subject to a sudden change and the open position, when the moving member moves towards the closed position, and the closed position, when the moving member moves towards the open position.

Other embodiments of the invention which give rise to noisier operation of the actuator are also envisaged. One advantage of these other embodiment is that they can be used when the machine in which the embodiments take place is starting or when the machine is operating at a speed greater than some predetermined speed, such as 2000 revolutions per minute (rpm).

These and other objects, advantages and features of embodiments of the invention, together with the organization and manner of operation thereof, will become apparent from the following detailed description when taken in conjunction with the accompanying drawing, wherein like elements have like numerals throughout the drawing described below.

BRIEF DESCRIPTION OF THE DRAWING

FIG. 1 is an illustration of a mechanical device comprising a valve and a moving member which can be actuated to perform a method of determining timing clearance according to embodiments of the present invention.

DETAILED DESCRIPTION

As used herein, the term "timing clearance" means the distance between a first point defined as the point at which the moving member 8 is set into motion and a second point defined as the point at which the moving member is located at the start of variation in the reference electrical characteristic.

A first embodiment of the invention is a method of determining timing clearance between a valve stem 3 and a moving member 8 using an electromagnetic actuator comprising electromagnetic displacement means which comprise electromagnets 14 and 15 for moving the moving member 8 between an extreme closed position and an extreme open position, the electromagnets 14 and 15 of the electromagnetic displacement means being controlled by servo-control means on the basis of a reference electrical characteristic. The method comprises: controlling the electromagnetic displacement means to obtain a substantially constant displacement speed for the moving member 8 as the moving member 8 moves between the extreme closed position and the extreme open position; obtaining values of the reference electrical characteristic for intermediate positions of the moving member; and detecting an intermediate position at which the reference electrical characteristic is subject to a sudden change. The method can further comprise deducing the timing clearance from the intermediate position at which the reference electrical characteristic is subject to a sudden change and the extreme closed position.

A second embodiment of the invention is a method of determining timing clearance between a valve stem 3 and a moving member 8 using an electromagnetic actuator which comprises electromagnets 14 and 15, an electromagnet 15 for moving the moving member 8 from a closed position towards an open position and an electromagnet 14 for moving the moving member 8 from an open position towards a closed position, each electromagnet being controlled on the basis of a reference electrical characteristic. The electromagnets 14 and 15 can be controlled by a servo-controller. The method comprises: controlling an electromagnet 14 or 15 to obtain a displacement speed for a moving member 8 as the moving member 8 moves from one of a closed position or an open position towards the other one of an open position or a closed position; obtaining values of a reference electrical characteristic for intermediate positions of the moving member 8; and detecting an intermediate position at which the reference electrical characteristic is subject to a sudden change. The method can further comprise deducing the timing clearance from the intermediate position at which the reference electrical characteristic is subject to a sudden change and the open position, when the moving member 8 moves towards the closed position, and the closed position, when the moving member 8 moves towards the open position. Under such circumstances, the displacement speed of the moving member 8 can be maintained at a substantially constant speed from, for example, a middle intermediate position of the armature 12.

The embodiments of the invention can be used in engines 2 comprising valves 1 each valve 1 associated with a respective actuator 6. The embodiments serve to determine the timing clearance that exists between each valve stem 3 and the moving member 8 of the actuator 6 that cooperates with the valve stem 3 in order to move the valve 1 between an open position in which the valve 1 is spaced apart from its seat 5, and an extreme closed position in which the valve 1 is properly pressed against its seat 5.

The embodiments of the invention are described with reference to FIG. 1. A valve 1 is comprised of a valve stem 3 which is mounted in a cylinder head 4. The cylinder head 4 can be located inside of any suitable mechanical device, including, but not limited to, an engine. The valve 1 is located at some point between an extreme closed position, in which the valve 1 is properly pressed against a seat 5 of the cylinder head 4, and an open position, in which the valve 1 is separated from the seat 5 of the cylinder head 4.

Between the extreme closed position and the open position, the valve 1 is actuated by means of an actuator 6 which is mounted on the cylinder head 4 of a suitable mechanical device. FIG. 1 depicts an engine 2 as an exemplary mechanical device in which the embodiments can operate. The actuator can be mounted on other locations within an engine or other suitable mechanical device as well.

The actuator 6 comprises a body 7 having a moving member 8 slidably mounted therein. The moving member 8 comprises a rod 9 with a first end 10 arranged to bear against a free end of the valve stem 3, and a second end 11 secured to an armature 12 received in a housing 13 of the body 7 to slide parallel to the rod 9.

The body 7 comprises electromagnetic displacement means for moving the moving member 8. The electromagnetic displacement means can comprise an electromagnet 14 for holding the armature 12 in an extreme closed position of the valve 1, and an electromagnet 15 for holding the armature 12 in an open position of the valve 1, wherein the electromagnets are open to two opposite faces of the housing 13 of the body 7. In this case, the armature 12 comes into contact with the electromagnet 14 when it is in the extreme closed position and the armature 12 comes into contact with the electromagnet 15 when it is in the extreme open position.

The electromagnets 14 and 15 can be servo-controlled by means (not shown) from a reference electrical characteristic and from a displacement speed of the moving member 8. The method of servo-control of devices such as electromagnets is known to one of ordinary skill in the art. Such servo-control in an engine, for example, can be performed by an engine controller unit which makes use of a signal representative of the speed of the armature 12 and obtained by computing the derivative of a position signal supplied by a sensor 16 for sensing the position of the rod 9. The sensor 16 can be any number of types of sensors, including, but not limited to, a conventional Hall effect sensor.

The displacement speed of the moving member 8 can be kept substantially constant while the moving member 8 moves from an closed position towards an open position, or at least while the moving member 8 is moving over a distance that is greater than the maximum possible timing clearance, given the geometrical characteristics of the actuator 6, the valve 1 and the cylinder head 4.

The reference electrical characteristic can include, but is not limited to, a reference current or a reference voltage.

In a manner known to one of ordinary skill in the art, the actuator 6 includes a resilient displacement means.

The resilient displacement means comprise a spring 17 interposed between a face 18 of the body 7 and a shoulder 19 of the rod 9 to urge the armature 12 towards the extreme open position, and a spring 20 interposed between a face 21 of the cylinder head 4 and a shoulder 22 on the valve stem 3 in order to urge the valve 1 into the closed position.

The actuator 6, the cylinder head 4, and the valve 1 are arranged in such a manner that when the armature 12 is in the extreme closed position and the valve 1 is pressed against its seat 5, there exists timing clearance j between the first end 10 of the rod 9 and the free end of the valve stem 3.

Reference electrical characteristic values for intermediate positions of the moving member 8 during movement of the moving member 8 from a closed position towards an open position or from an open position towards a closed position can be obtained by a number of methods, including, but not limited to, supply by servo-control means, measurement or detection. The intermediate positions of the moving member 8 can be supplied by a position sensor 16. The reference electrical characteristic values can then be associated with the intermediate positions of the moving member 8.

Detecting an intermediate position of the moving member 8 in which the reference electrical characteristic is subject to a sudden change can be based on computing values of the derivative of the reference electrical characteristic relative to the position of the moving member 8. When this derivative is plotted as a curve, the curve presents peaks at the intermediate position corresponding to the point at which the moving member 8 comes into contact with the valve stem 3. The peak or peaks are the peak derivative value or peak derivative values, respectively. As used herein, the term "peak derivative value" is the derivative value or derivative values corresponding to the point at which the curve presents peaks.

The distance between the extreme closed position and the intermediate position corresponding to the point at which the moving member 8 comes into contact with the valve stem 3 when the moving member is moving towards the open position can be deduced. This distance corresponds to the timing clearance j in the first embodiment.

Likewise, as in the second embodiment, the distance between the extreme open position and the intermediate position when the moving member is moving towards the closed position can be deduced. This distance corresponds to the timing clearance j in the second embodiment.

With reference to the first embodiment, for example, taking a reference current as an example of the reference electrical characteristic, when the electromagnetic displacement means causes the moving member 8 to move from the extreme closed position to the extreme open position, the sudden change in the reference current is representative of a sudden increase occurring in the force opposing the movement of the moving member 8. This increase in the opposing force produced by the spring which moves the valve 1 towards the extreme closed position wherein the spring tends to oppose movement of the valve 1 towards the extreme open position and the opposing force occurs at the moment when the moving member 8 comes into contact with the valve stem 3. This sudden change in the reference current can be associated immediately with an intermediate position of the moving member 8. Knowing the extreme closed position and the intermediate position of the moving member 8 at which the reference electrical characteristic is subject to a sudden change, a precise value for the timing clearance can be easily deduced therefrom.

While the moving member 8 is moved from its extreme closed position to its extreme open position, the electromagnetic means can be controlled initially to bring the moving member 8 gently up to the intermediate position corresponding to the point at which the moving member 8 comes into contact with the valve stem 3 so as to put the moving member 8 into contact with the valve stem 3. After bringing the moving member 8 up to the intermediate position corresponding to the point at which the moving member 8 comes into contact with the valve stem 3, the moving member 8 can be accelerated once it is pressing against the valve stem.

While moving the moving member 8 from the extreme open position to the extreme closed position, the electromagnetic means may be controlled firstly to bring the moving member 8 quickly to the intermediate position corresponding to the point at which the moving member 8 comes into contact with the valve stem 3 in order to have rapid closure of the valve 1, after which the moving member 8 can be brought gently into the extreme closed position in order to limit contact noise between the armature 12 and the electromagnet 14.

The timing clearance j can be determined periodically. For example, the period for determining the timing clearance can include, but is not limited, one second. Further, the timing clearance can be determined while using different modes of operation of the mechanical device in which the timing clearance is determined. This can depend on the speed of the mechanical device and its mode of operation.

With reference to the first and second embodiments as well as the other envisaged embodiments referenced above, and for the case in which the embodiments are performed in an engine, the embodiment of the invention used can depend on the speed of an engine and its mode of operation. For instance, since implementation of the first or second embodiment of the invention does not interfere with normal operation of the actuator 6, they do not generate additional noise, and they can therefore be used at idling speeds as well as at normal operation speeds. Other envisaged embodiments which gives rise to noisier operation of the valve actuator 6, can be used when the engine is starting or when the engine is operating at a speed greater than some predetermined speed, such as 2000 revolutions per minute (rpm).

The foregoing description of embodiments of the invention has been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated.

What is claimed is:

1. A method of determining timing clearance between a valve stem and a moving member using an electromagnetic actuator comprising electromagnetic displacement means which comprise electromagnets for moving the moving member between an extreme closed position and an extreme open position, the electromagnets of the electromagnetic displacement means being controlled by servo-control means on the basis of a reference electrical characteristic, the method comprising:

controlling the electromagnetic displacement means to obtain a substantially constant displacement speed for the moving member between the extreme closed position and the extreme open position;

obtaining values of the reference electrical characteristic for intermediate positions of the moving member; and detecting an intermediate position at which the reference electrical characteristic is subject to a sudden change.

2. A method according to claim 1, wherein detecting an intermediate position at which the reference electrical characteristic is subject to a sudden change comprises computing at least one derivative of the reference electrical characteristic relative to at least one position of the moving member.

3. A method according to claim 2 wherein the reference electrical characteristic is a current.

4. A method according to claim 3, wherein the displacement speed of the moving member is maintained at a speed that is substantially constant over a fraction of the movement of the moving member corresponding to a maximum timing clearance.

5. A method according to claim 1 wherein the reference electrical characteristic is a current.

6. A method according to claim 1 wherein the reference electrical characteristic is a voltage.

7. A method according to claim 1 wherein the valve stem is an engine valve stem.

8. A method according to claim 2 wherein the reference electrical characteristic is a voltage.

9. A method according to claim 2 wherein the displacement speed of the moving member is maintained at a speed that is substantially constant over a fraction of the movement of the moving member corresponding to a maximum timing clearance.

10. A method according to claim 3 wherein the displacement speed of the moving member is maintained at a speed that is substantially constant over a fraction of the movement of the moving member corresponding to a maximum timing clearance.

11. A method of determining timing clearance between a valve stem and a moving member using an electromagnetic actuator comprising electromagnets, the actuator being controlled on the basis of a reference electrical characteristic, the method comprising:

controlling an electromagnet to obtain a displacement speed for a moving member as the moving member moves from one of a closed position and an open position towards the other one of the open position and the closed position;

obtaining values of a reference electrical characteristic for intermediate positions of the moving member; and detecting an intermediate position at which the reference electrical characteristic is subject to a sudden change.

12. A method according to claim 11, wherein detecting an intermediate position at which the reference electrical characteristic is subject to a sudden change comprises computing at least one derivative of the reference electrical characteristic relative to at least one position of the moving member.

13. A method according to claim 11, wherein detecting an intermediate position at which the reference electrical characteristic is subject to a sudden change comprises:

computing at least one derivative of the reference electrical characteristic relative to at least one position of the moving member; and determining the intermediate position corresponding to the point of the peak derivative value.

14. A method according to claim 11 wherein the reference electrical characteristic is a current.

15. A method according to claim 11 wherein the valve stem is an engine valve stem.

16. A method according to claim 11 wherein controlling the electromagnets is performed by a servo-controller.

17. A method according to claim 11 wherein the displacement speed of the moving member is maintained at a speed that is substantially constant over the entire movement of the moving member as the moving member moves from one of a closed position or an open position towards the other one of an open position or a closed position.

18. A method according to claim 11 wherein the displacement speed of the moving member is maintained at a speed that is substantially constant over a fraction of the movement of the moving member corresponding to a maximum timing clearance.

19. A method according to claim 11 wherein obtaining values of the reference electrical characteristic for intermediate positions of the moving member is performed by a servo-controller.

20. A method according to claim 11 wherein obtaining values of the reference electrical characteristic for intermediate positions of the moving member is performed by a measuring device.

21. A method according to claim 11 wherein obtaining values of the reference electrical characteristic for intermediate positions of the moving member is performed by a detection device.

22. A method according to claim 11, further comprising deducing a timing clearance.

23. A method according to claim 22, wherein deducing the timing clearance is based on the closed position and the intermediate position.

24. A method according to claim 22, wherein deducing the timing clearance is based on the open position and the intermediate position.

25. A method according to claim 12 wherein the reference electrical characteristic is a current.

26. A method according to claim 12 wherein the displacement speed of the moving member is maintained at a speed that is substantially constant over the entire movement of the moving member as the moving member moves from one of a closed position or an open position towards the other one of an open position or a closed position.

27. A method according to claim 12 wherein the displacement speed of the moving member is maintained at a speed that is substantially constant over a fraction of the movement of the moving member corresponding to a maximum timing clearance.

* * * * *